US005628167A

United States Patent [19]

Huson et al.

[11] Patent Number: 5,628,167

[45] Date of Patent: May 13, 1997

[54] METHOD AND APPARATUS FOR WRAPPING ELONGATE LOAD HAVING GENERALLY CIRCULAR OR GENERALLY ANNULAR ENDS

[75] Inventors: Gale W. Huson, Glenview, Ill.; Werner K. Diehl, Parkland, Fla.

[73] Assignee: Illinois Tool Works Inc., Glenview, Ill.

[21] Appl. No.: 502,130

[22] Filed: Jul. 13, 1995

[51] Int. Cl.[6] ..... B65B 11/04; B65B 53/00

[52] U.S. Cl. ..... 53/465; 53/441; 53/556; 53/210; 53/211

[58] Field of Search ..... 53/204, 210, 211, 53/215, 441, 465, 588, 556

[56] References Cited

U.S. PATENT DOCUMENTS

| | | | |
|---|---|---|---|
| 4,109,445 | 8/1978 | Shulman . | |
| 4,173,108 | 11/1979 | Eglington et al. | 53/211 X |
| 4,281,500 | 8/1981 | Mueller et al. | 53/211 |
| 4,362,001 | 12/1982 | Cockerham, Jr. et al. | 53/441 |
| 4,565,051 | 1/1986 | Back | 53/441 |
| 4,772,170 | 9/1988 | Ball et al. | 53/556 |
| 4,912,911 | 4/1990 | Down | 53/465 |
| 5,048,271 | 9/1991 | Walton | 53/587 |
| 5,140,795 | 8/1992 | Steding | 53/168 |
| 5,195,301 | 3/1993 | Martin-Cocher | 53/441 |
| 5,203,139 | 4/1993 | Salsburg et al. | 53/430 |

FOREIGN PATENT DOCUMENTS

| | | | |
|---|---|---|---|
| 484029 | 5/1992 | European Pat. Off. | 53/211 |
| 2756850 | 6/1978 | Germany | 53/588 |
| 4137448 | 5/1993 | Germany | 53/211 |
| 2121751 | 1/1984 | United Kingdom . | |
| 2200887 | 8/1988 | United Kingdom . | |

OTHER PUBLICATIONS

Brochure, MIMA guide to Semiautomatic programmable platfrom stretch wrappers for large cylindrical loads, four pages (1967).

*Primary Examiner*—Linda Johnson
*Attorney, Agent, or Firm*—Schwartz & Weinrieb

[57] ABSTRACT

An apparatus is useful for wrapping a wrapping film over an elongate load, which has a generally cylindrical exterior and two generally circular or generally annular ends. Two blocker rollers cradle the load with its axis extending horizontally and are arranged for rotating the load about the load axis. A dispenser mounts a roll of the wrapping film with its axis extending vertically. The dispenser is mounted on a rotatable arm, which is rotatable about a vertical axis. A carriage is provided for mounting the dispenser and for carrying the dispenser and the roll back and forth along the cradled load. Thus, the roll is moved along an oblong path, whereby the film pulled from the roll is wrapped over the near side of the load, one end of the load, the far side of the load, and the other end of the load, as the load is rotated. The roll remains at an elevation above a central portion of the load so as to permit the central portion to remain unwrapped.

17 Claims, 2 Drawing Sheets

FIG. 2
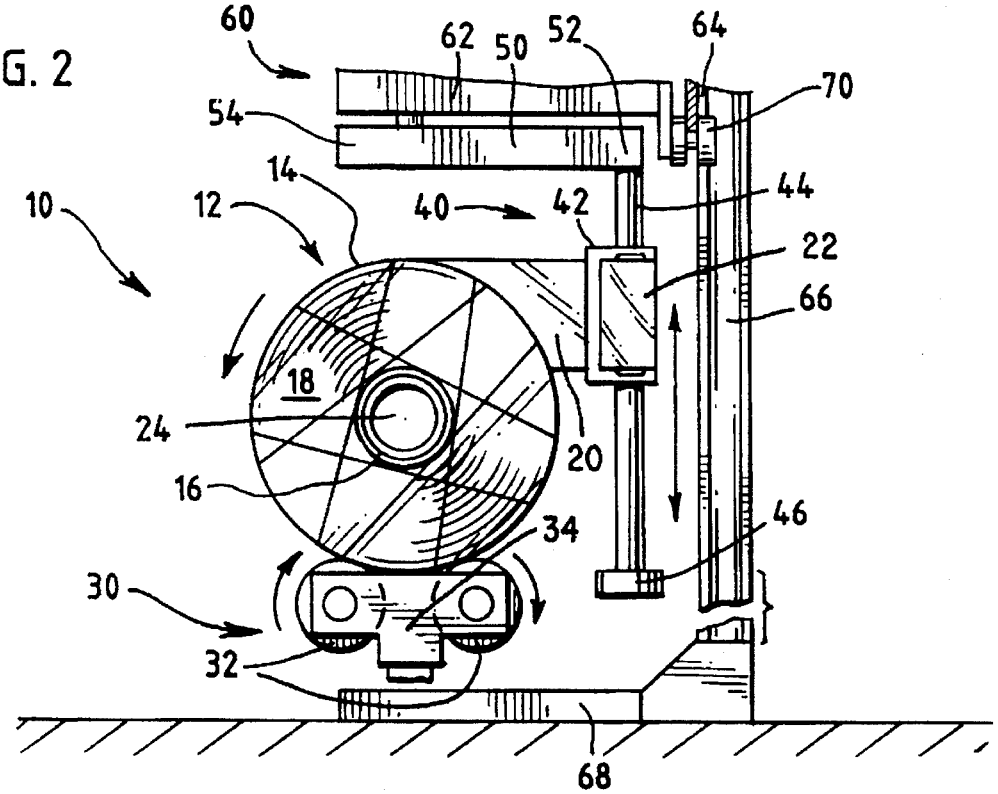
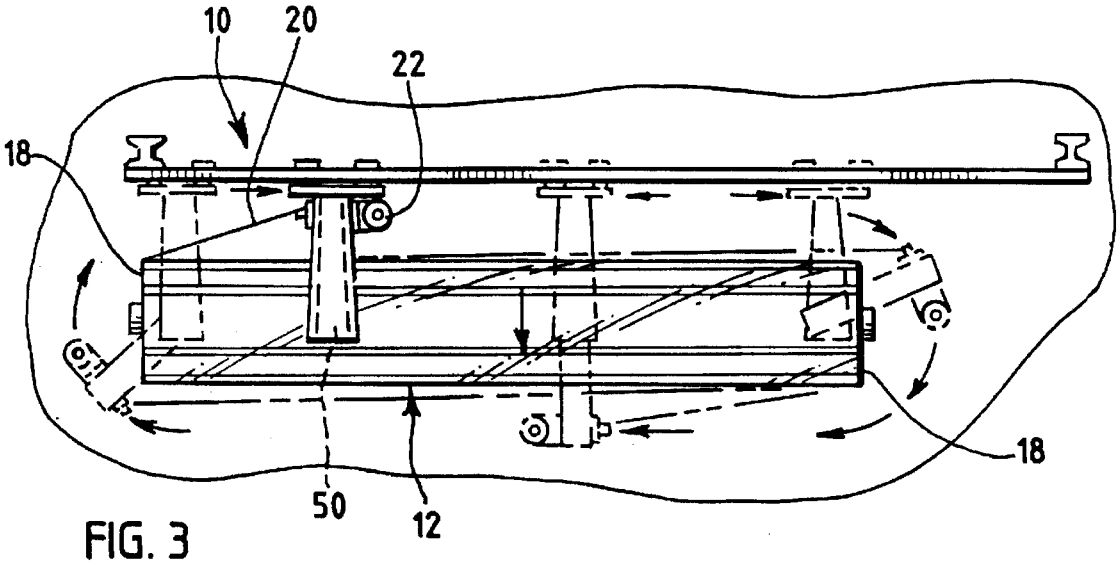
FIG. 3

METHOD AND APPARATUS FOR WRAPPING ELONGATE LOAD HAVING GENERALLY CIRCULAR OR GENERALLY ANNULAR ENDS

TECHNICAL FIELD OF THE INVENTION

This invention pertains to a method and apparatus for wrapping an elongate load having generally circular or generally annular ends, such as a textile roll having a tubular core, with a Wrapping film, such as a stretch film. In a preferred mode, which is useful particularly with an elongate load having generally annular ends, a central portion of each end of the load remains unwrapped.

BACKGROUND OF THE INVENTION

Commonly, an elongate load having generally annular ends, such as a textile roll having a tubular core, is wrapped with a wrapping film, such as a shrink or stretch film, in a full web pattern as the elongate load is positioned axially within a film delivery system. The wrapping film is gathered at the opposite ends of the wrapped load, and the gathered film is clamped, welded to itself, or tied.

Therefore, if it is desired to insert a lift arm of a lift truck into a selected end of the wrapped load, it is necessary to break through the wrapping film at the selected end. Breaking through the wrapping film can leave ragged edges by means of which the wrapping film may begin to unwrap from the wrapped load, and whereby, in addition, the wrapped load may be exposed to soiling or damage.

SUMMARY OF THE INVENTION

This invention provides a method and apparatus for wrapping a wrapping film, supplied from a roll defining a roll axis over an elongate load, which has a generally cylindrical exterior defining a load axis and which has two generally circular or generally annular ends. In a preferred mode, which is useful particularly with an elongate load having generally annular ends, the method permits a central portion of each end of the load to remain unwrapped.

Broadly, the method comprises the steps of cradling the load with the load axis extending horizontally, mounting the roll of film with the roll axis extending vertically, and moving the mounted roll around successive halves of a circular path and back and forth along the load so that the roll is moved along an oblong path with a straight section along each side of the load and with a half-circular section around each end of the load, as the cradled load is rotated about the load axis, so as to wrap the near side of the load, one end of the load, the far side of the load, and the other end of the load with the wrapping film pulled from the roll.

Preferably, the load is cradled so as to be rotatable about the load axis, and the method further comprises rotating the cradled load about the load axis as the roll is moved along the oblong path, the roll remaining at an elevation above a central portion of each end of the load so as to permit the central portion to remain unwrapped.

Preferably, the moving and rotating steps are performed by moving the roll in one direction along the load while the load is being rotated, moving the roll across one end of the load while the load is not being rotated, moving the roll oppositely along the load while the load is being rotated, and moving the roll across the other end of the load while the load is not being rotated.

In the apparatus provided by this invention, means are provided for cradling the load with the load axis extending horizontally so as to define a near side of the load and a far side of the load, and so as to permit the load to be rotated about the load axis, for mounting the roll film with the roll axis extending vertically and for moving the mounted roll around successive halves of a cylindrical path and back and forth along the load so that the roll is moved along an oblong path with a straight section along each side of the load and with a half-circular section around each end of the load, as the cradled load is rotated about the load axis, so as to wrap the near side of the load, one end of the load, the far side of the load, and the other end of the load with the wrapping film pulled from the roll.

Preferably, the apparatus further comprises means for rotating the cradled load about the load axis as the roll is moved along the oblong path, the roll remaining at an elevation above a central portion of each end of the load so as to permit the central portion to remain unwrapped.

Preferably, moreover, the mounting and moving means include a track extending horizontally, a carriage movable along the track, and an arm having a distal end and a proximal end, the roll being mounted upon the distal end and the proximal end being rotatably mounted upon the carriage so that the arm is rotatable about a vertical axis at the proximal end.

Preferably, furthermore, the mounting and moving means and the rotating means are operable for moving the carriage so as to move the roll of film in one direction along the load while the arm is not being rotated but while the load is being rotated, rotating the arm so as to move the roll of film in an arc across one end of the load while the load is not being rotated, moving the carriage so as to move the roll of film oppositely along the load while the arm is not being rotated but while the load is being rotated, and rotating the arm so as to move the roll of film in an arc across the other end of the load while the load is not being rotated.

BRIEF DESCRIPTION OF THE DRAWINGS

These and other objects, features, and advantages of this invention will be evident from the following description of a preferred embodiment of this invention when reference is made to the accompanying drawings in which like reference characters designate like or corresponding parts throughout the several view and wherein:

FIG. 2 is an end view of the wrapping apparatus, the elongate load, and the stretch film, as shown in FIG. 1.

FIG. 3 is a plan view of the wrapping apparatus, the elongate load, and the stretch film, as shown in FIG. 1.

DETAILED DESCRIPTION OF THE PREFERRED EMBODIMENT

Figure 1:
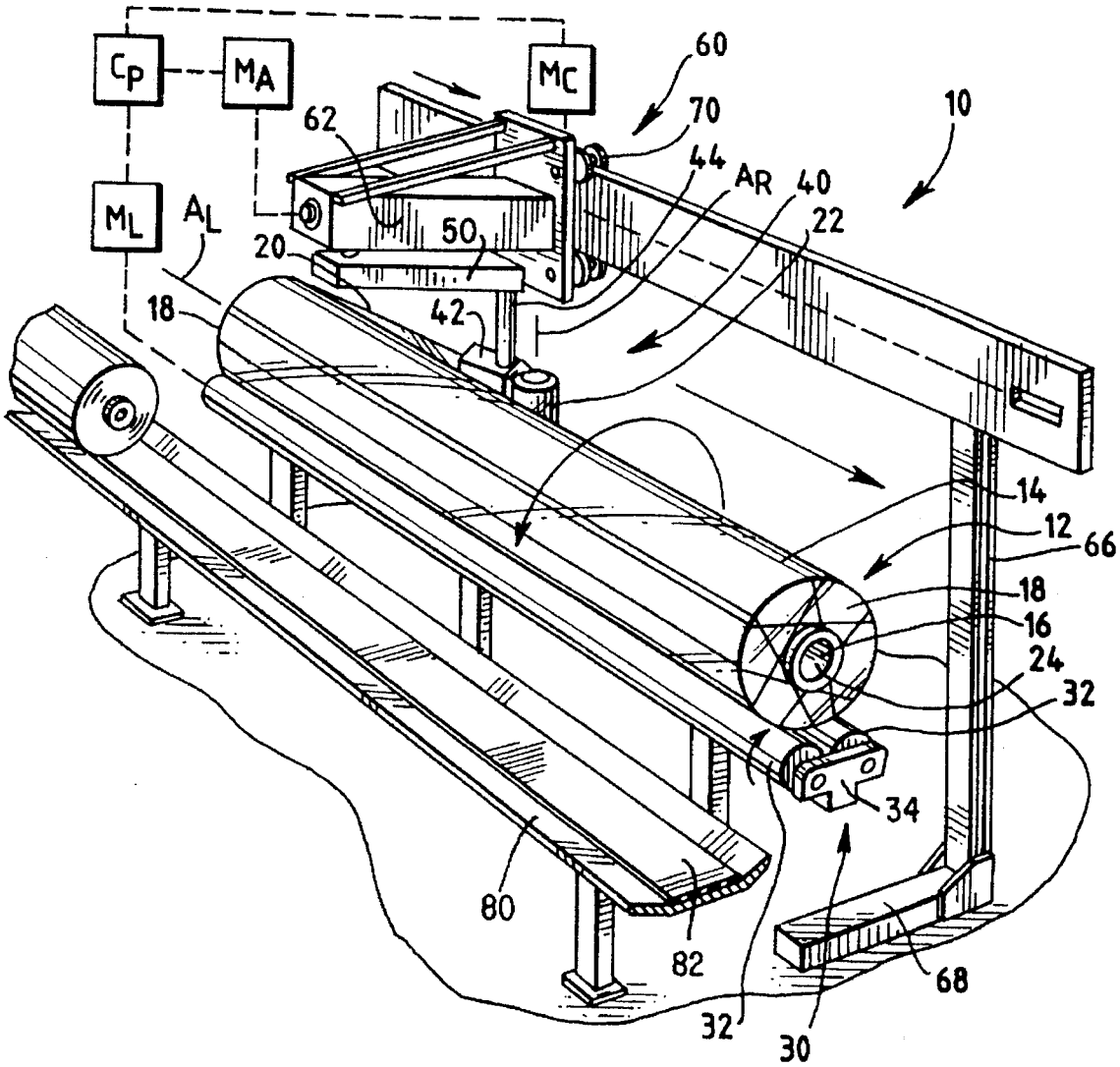
FIG. 1 is a simplified, perspective view of a wrapping apparatus constituting a preferred embodiment of this invention, as used for wrapping an elongate load having generally annular ends, with a wrapping film, such as a stretch film.

As shown in the drawings, an apparatus 10 constituting a preferred embodiment of this invention can be advantageously employed for wrapping an elongate load 12, having a generally cylindrical exterior 14, a tubular core 16, and generally annular ends 18, with a stretch film 20 from a roll 22, in a manner described below, so as to permit a central portion 24 of the tubular core 16 at each end 18 of the load 12 to remain unwrapped. Therefore, if it is desired to insert a lift arm (not shown) of a lift truck into the central portion 24 of the tubular core 16 at a selected end 18 of the wrapped load 12, it is not necessary to break through the stretch film 20 at the selected end.

As examples, which are not intended as limiting, the load 12 may be a textile, carpeting, or paper roll, in which the tubular core 16 is a wound paper core. The load 12 defines a load axis $A_L$ and the roll 22 of the stretch film 20 defines a roll axis $A_R$.

The apparatus 10 comprises means 30 including a pair of blocker rolls 32, which are rotatably mounted upon a support 34 so as to extend horizontally in side-by-side relation with respect to each other, for cradling the load 12 with the load axis $A_L$ extending horizontally so as to define a near side of the load 12 and a far side of the load 12, and so as to permit the load 12 to be rotated about the load axis $A_L$. The cradling means 30 further includes a motor $M_L$, which is shown diagrammatically, and which is arranged to rotate one of the blocker rolls 32 so as to rotate the cradled load 12 about the load axis $A_L$.

The apparatus 10 further comprises means 40 including a dispenser 42 for mounting the roll of film 22 with the roll axis $A_R$ extending vertically so as to permit the film 20 to be pulled horizontally from the roll 22. The dispenser 42 is mounted so as to be selectively positionable along a vertical shaft 44, which is suspended from a rotatable arm 50. The dispenser 42 is positioned along the vertical shaft 44 so as to position the roll 22 at an elevation above the tubular core 16 at each end 18 of the load 12. The vertical shaft 44 mounts a lower stop 46, which limits positioning of the dispenser 42 in a downward direction. The rotatable arm 50 limits positioning of the dispenser 42 in an upward direction. The rotatable arm 50 has a distal end 52, from which the vertical shaft 44 is suspended, and a proximal end 54.

The apparatus 10 further comprises means 60 including a carriage 62, below and to which the arm 50 is rotatably mounted at the proximal end 54, and a motor $M_A$, which is arranged to rotate the arm 50 relative to the carriage 62. The carriage 62 has wheels 70, which enable the carriage 62 to move back and forth along a track 64 extending horizontally and supported on upright columns 66 with lower stabilizing legs 68, and is arranged for moving the mounting means 40 (which includes the dispenser 42, the vertical shaft 44 and the rotatable arm 50) and the mounted roll 22 back and forth along the near side of the cradled load 12. The carrying means 60 further includes a motor $M_C$, which is arranged to move the carriage 62, the mounting means 40, and the mounted roll 22 back and forth along the track 64, and the motor $M_A$, which is arranged for rotating the rotatable arm 50 about the vertical axis through the proximal end 54.

The motor $M_L$ for rotating the cradled load 12, the motor $M_A$ for rotating the arm 50 relative to the carriage 12, and the motor $M_C$ for moving the carriage 62 back and forth along the track 64 are cyclicly controlled by means of a programmable controller $C_P$ or a computer (not shown) so that the carriage 62 is moved by means of the motor $M_L$ in a first direction along the track 64 so as to move the roll 22 in the first direction along the near side of the cradled load 12 while the arm 50 is not being rotated but while the cradled load 12 is being rotated by means of the motor $M_L$, so that the arm 50 is rotated by means of the motor $M_A$ over a first half of one revolution so as to move the cradled roll 22 in an arc across a first end 18 of the load 12 while the cradled load 12 is not being rotated, so that the carriage 62 is moved by means of the motor $M_C$ in a second (opposite) direction along the track 64 so as to move the roll 22 in the second direction along the far side of the cradled load 12 while the arm 50 is not being rotated but while the cradled load 12 is being rotated by means of the motor $M_L$, and so that the arm 50 is rotated by means of the motor $M_A$ over the second (opposite) half of one revolution so as to move the roll 22 in an arc across the second (opposite) end 18 of the cradled load 12 while the cradled load 12 is not being rotated. The carriage 62 may or may not be moving when the roll 22 is moved in an arc in either direction.

Consequently, the roll 22 is moved along an oblong path with a straight section along each side of the cradled load 12 and with a half-circular section around each end 18 of the cradled load 12, as the cradled load 12 is rotated about the load axis $A_L$, so as to wrap the near side of the cradled load 12, one end 18 of the cradled load 12, the far side of the cradled load 12, and the other end 18 of the cradled load 12, with the stretch film 20 pulled from the roll 22.

As shown in FIG. 1, a conveyor 80 employing an endless belt 82 is employed to deliver successive loads 12, which are transferred manually or otherwise onto the blocker rolls 32 of the cradling means 30 of the apparatus 10. The conveyor 80 is also employed to remove each load 12 after such load 12 has been wrapped.

After an initial length of the stretch film 20 has been manually pulled from the roll 22, a free end of the initial length is taped or otherwise secured to the cradled load 12, whereupon the apparatus 10 is operated. Because the cradled load 12 is rotated about the load axis $A_L$ as the stretch film 20 is pulled from the roll 22 onto the cradled load 12, the stretch film 20 tends to contact the cradled load 12 or previously wrapped layers of the stretch film 20 between the opposite edges of the stretch film 20 and to be spirally wrapped around the cradled load 12, at a slight inclination relative to the load axis $A_L$ along each side of the cradled load 12.

Because the roll 22 remains at an elevation above the tubular core 16 at each end 18 of the load 12, the tubular core 16 remains unwrapped at each end 18 of the cradled load 12. In multiple cycles of the apparatus 10, the cradled load 12 can be completely wrapped with the stretch film 20 pulled from the roll 22, except that the tubular core 16 remains unwrapped at each end 18 of the cradled load 12.

Various modifications may be made in the preferred embodiment described above without departing from the scope and spirit of this invention. It is therefore to be understood that within the scope of the appended claims, the present invention may be practiced otherwise than as specifically described herein.

We claim:

1. A method of wrapping an elongate load, having a longitudinal axis, with wrapping film, comprising the steps of:

supporting an elongate load having a longitudinal axis, oppositely disposed longitudinally extending sides, and oppositely disposed transversely extending ends;

mounting a carriage at a position adjacent to one of said oppositely disposed longitudinally extending sides of said elongate load such that said carriage is able to undergo reciprocating movement along said one of said oppositely disposed longitudinally extending sides of said elongate load;

mounting a roll of wrapping film upon a support arm;

mounting said support arm upon said carriage such that said support arm is pivotable with respect to said carriage whereby said roll of wrapping film can be disposed adjacent to either one of said oppositely disposed longitudinally extending sides and either one of said oppositely disposed transversely extending ends of said elongate load so as to be able to wrap said wrapping film about said oppositely disposed longitudinally extending sides and said oppositely disposed transversely extending ends of said elongate load; and reciprocating said carriage while pivoting said support arm with respect to said carriage at predetermined times so as to permit said roll of wrapping film to traverse an oblong path about said elongate load comprising movement along each one of said oppositely disposed longitudinally extending sides and along each one of said oppositely disposed transversely extending ends of said elongate load so as to wrap said wrapping film about said oppositely disposed longitudinally extending sides and said oppositely disposed transversely extending ends of said elongate load.

2. A method of wrapping an elongate load as set forth in claim 1, further comprising the steps of:

orienting said elongate load such that said longitudinal axis of said elongate load is disposed horizontally; and orienting said roll of wrapping film such that an axis thereof, about which said roll of wrapping film rotates as said wrapping film is unrolled from said roll of wrapping film during wrapping of said wrapping film about said elongate load, is disposed vertically.

3. A method of wrapping an elongate load as set forth in claim 1, wherein:

said step of supporting said elongate load comprises rotatably supporting said elongate load such that said elongate load is rotatable about said longitudinal axis thereof.

4. The method of wrapping an elongate load as set forth in claim 3, further comprising:

the step of rotating said load about said load axis as said roll of wrapping film is moved along said oblong path and while said roll of wrapping film is maintained at an elevational level which is above a central portion of each end of said load so as to permit said central portion of each end of said load to remain unwrapped.

5. The method of wrapping an elongate load as set forth in claim 4, wherein:

said steps of moving said roll of wrapping film and said roll of wrapping film in one direction along said rotating said elongate load are performed by moving one of said longitudinally extending sides of said load while said elongate load is being rotated, moving said roll of wrapping film across said one of said transversely extending ends of said elongate load while said elongate load is not being rotated, moving said roll of wrapping film in an opposite direction along an opposite one of said longitudinally extending sides of said elongate load while said elongate load is being rotated, and moving said roll of wrapping film across an opposite one of said transversely extending ends of said elongate load while said elongate load is not being rotated.

6. Apparatus for wrapping an elongate load, having a longitudinal axis, with wrapping film, comprising:

means for supporting an elongate load having a longitudinal axis, oppositely disposed longitudinally extending sides, and oppositely disposed transversely extending ends;

carriage means mounted adjacent to said supporting means and one of said oppositely disposed longitudinally extending sides of said elongate load for undergoing reciprocating movement along said one of said oppositely disposed longitudinally extending sides of said elongate load;

a roll of wrapping film;

a support arm, having said roll of wrapping film mounted thereon, pivotally mounted upon said carriage means such that said roll of wrapping film can be disposed adjacent to either one of said oppositely disposed longitudinally extending sides and either one of said oppositely disposed transversely extending ends of said elongate load so as to wrap said wrapping film about said oppositely disposed longitudinally extending sides and said oppositely disposed transversely extending ends of said elongate load; and means for reciprocating said carriage means, and pivoting said support arm with respect to said carriage means at predetermined times, so as to permit said roll of wrapping film to traverse an oblong path about said elongate load comprising movement along each one of said oppositely disposed longitudinally extending sides and along each one of said oppositely disposed transversely extending ends.

7. Apparatus as set forth in claim 6, wherein:

said elongate load has a substantially cylindrical configuration comprising substantially circular, annular ends.

8. Apparatus as set forth 6, wherein:

said longitudinal axis of said elongate load is disposed horizontally; and said roll of film has a longitudinal axis which is disposed vertically.

9. Apparatus as set forth in claim 6, wherein:

said support arm is pivotally mounted upon said carriage means at a proximal end of said support arm; and said roll of wrapping film is vertically movable along a vertically disposed shaft mounted upon a distal end of said support arm.

10. The apparatus of claim 6, further comprising:

means, comprising a track extending horizontally along said means for supporting said elongate load, for supporting said carriage means.

11. Apparatus as set forth in claim 10, further comprising:

wheel means provided upon said carriage means for travelling along said track.

12. Apparatus as set forth in claim 7, wherein:

said elongate load comprises a load selected from the group of a textile roll, a carpet roll, and a paper roll.

13. The apparatus of claim 7, further comprising:

means for rotating said elongate load about said load axis as said roll of wrapping film is moved along said oblong path and while said roll of wrapping film is maintained at an elevational level which is above a central portion of each one of said transversely disposed ends of said elongate load so as to permit a central portion of each one of said transversely disposed ends of said elongate load to remain unwrapped.

14. Apparatus as set forth in claim 13, wherein:

said means for supporting said elongate load comprises a pair of blocker rolls disposed in a side-by-side relationship with respect to each other so as to cradle said elongate load thereon; and said means for rotating said elongate load comprises a fix drive motor operatively connected to at least one of said blocker rolls.

15. Apparatus as set forth in claim 14, wherein:

said means for reciprocating said carriage means comprises a second drive motor; and said means for pivoting said support arm comprises a third drive motor.

16. Apparatus as set forth in claim 15, further comprising:

programmable means operatively connected to said first, second, and third drive motors for cyclically controlling said first, second, and third drive motors at predetermined times so as to properly rotate said elongate load, reciprocate said carriage means, and pivot said support arm, having said roll of wrapping film mounted thereon, in order to achieve desired wrapping of said elongate load with said wrapping film.

17. Apparatus as set forth in claim 14, further comprising:

conveyor means disposed adjacent to said pair of blocker rolls for conveying elongate loads to be wrapped to a position adjacent to said blocker rolls, and for conveying wrapped elongate loads away from said pair of blocker rolls.

* * * * *